US006418758B1

(12) United States Patent
Ikeda et al.

(10) Patent No.: US 6,418,758 B1
(45) Date of Patent: Jul. 16, 2002

(54) WASHING MACHINE

(75) Inventors: Tomohiko Ikeda, Kusatsu; Katsuhito Nakagawa, Otsu; Akira Takenaka, Kameoka; Yoshitaka Tsunomoto, Otsu, all of (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 102 days.

(21) Appl. No.: 09/613,143

(22) Filed: Jul. 10, 2000

(30) Foreign Application Priority Data

Jul. 16, 1999 (JP) ..... 11-203822

(51) Int. Cl.[7] ..... D06F 37/20

(52) U.S. Cl. ..... 68/12.06; 68/23.1; 68/23.2; 68/23.4

(58) Field of Search ..... 68/12.06, 23.1, 68/23.2, 23.3, 23.4, 23.5, 25

(56) References Cited

U.S. PATENT DOCUMENTS 2,534,267 A * 12/1950 Kahn
2,534,268 A * 12/1950 Kahn et al.
2,534,269 A * 12/1950 Kahn et al.
3,983,035 A * 9/1976 Arkeveld et al.
5,074,131 A * 12/1991 Hirose et al.
5,345,792 A * 9/1994 Farrington et al.
5,513,504 A * 5/1996 Sribar et al.
5,561,993 A * 10/1996 Elgersma et al.
5,582,040 A * 12/1996 Khan
5,768,730 A * 6/1998 Matsumoto et al.
5,782,110 A * 7/1998 Kim
5,893,280 A * 4/1999 Honda et al.
5,916,274 A * 6/1999 Lee et al.

FOREIGN PATENT DOCUMENTS

CA 503691 * 6/1954
GB A-2 138 029 10/1984
GB A-2 271 172 4/1994
NL 77196 * 2/1955

* cited by examiner

*Primary Examiner*—Frankie L. Stinson
(74) *Attorney, Agent, or Firm*—Oliff & Berridge, PLC

(57) ABSTRACT

The present invention proposes a washing machine having a simple-structured mechanism for correcting the balance of the drum. In an embodiment of the present invention, plural water-holding chambers are located at the back of the drum around the rotation axis. The water-holding chamber has an opening for introducing water from a water discharge port 15. At the start of an extracting operation, all the water-holding chambers are emptied by rotating the drum at low speed. After that, when the eccentric load due to an uneven distribution of the laundry is greater than an upper limit value, the drum is rotated at a preset speed and a water supply valve is opened. Thus, the water from the water discharge port 15 is supplied into all the water-holding chambers, and the water is held in the water-holding chamber by the centrifugal force. After that, the speed of the drum is temporarily reduced at a time point corresponding to the position of the eccentric load, whereby a part of the water held by one or some of the water-holding chambers at or close to the position of the eccentric load is let to spill out from the chamber. After thus canceling the load unbalance of the drum around the rotation axis as a whole, the drum is rotated at high speed for extraction.

8 Claims, 13 Drawing Sheets

Fig. 4
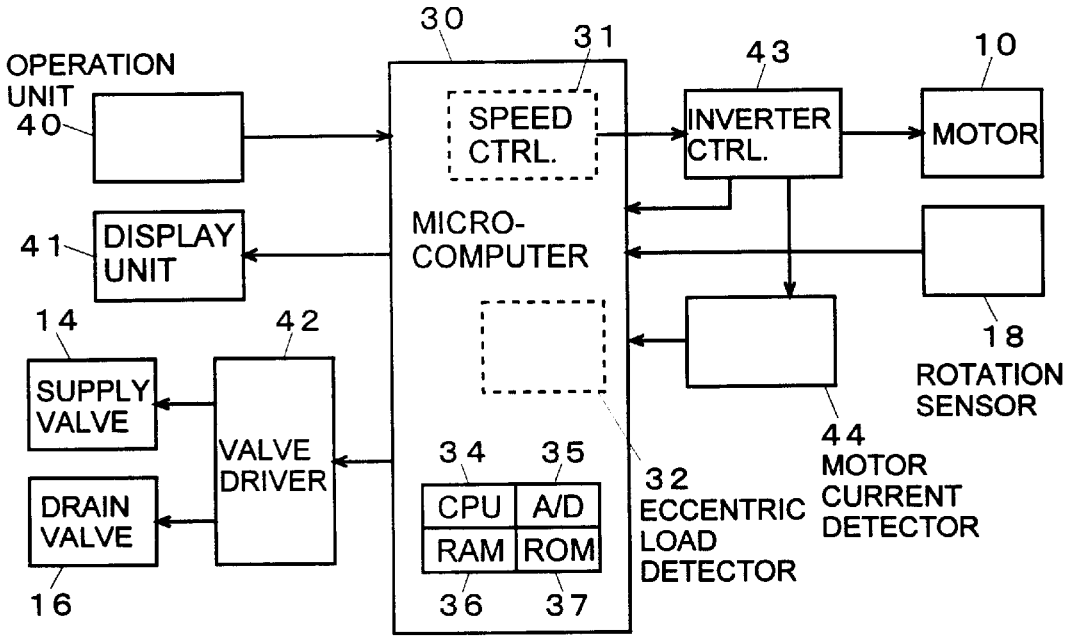
Fig. 5A
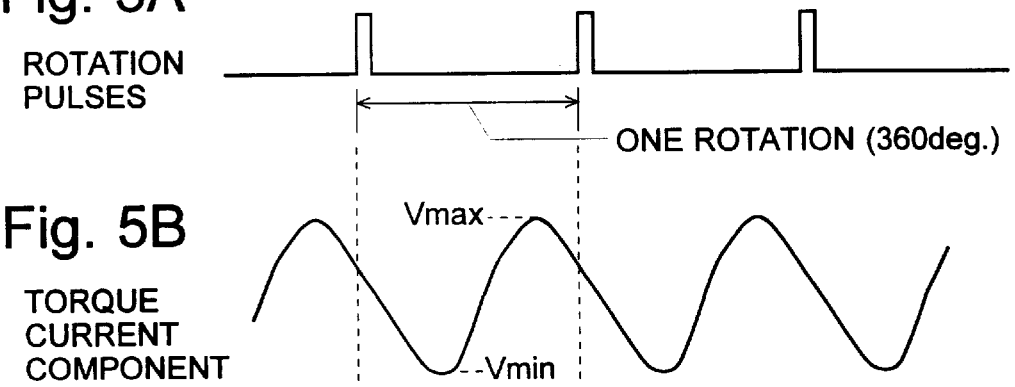
Fig. 5B

WATER IN BALANCER EQUALIZED

ON DECELERATION

AFTER CORRECTING BALANCE

WASHING MACHINE

The present invention relates to a washing machine having a spin-extracting function.

In particular, the present invention relates to a drum-type washing machine having a drum rotatable about a horizontal axis, or a whirlpool-type washing machine having a wash-and-extraction tub rotatable about a tilted axis.

BACKGROUND OF THE INVENTION

In general, a drum-type washing machine has a cylindrical basket drum rotatable about a horizontal axis. When the drum is rotated at high speed with the wet laundry loaded therein, the water held by the laundry is extracted and scattered by a centrifugal force. One problem concerning the extraction process is that abnormal vibration and/or noise arises when the drum is rotated at high speed if the mass distribution around the rotation axis is unbalanced as a result of uneven distribution of the laundry on the inner peripheral wall of the drum.

Various proposals have been made for solving the above-described problem. For example, UK Patent Publication Nos. GB2271172 and GB2138029 disclose washing machines having plural water-holding chambers or compartments (those utilizing the inner space of baffles, for example) located around the rotation axis of the drum. By this washing machine, water is supplied into one of the chambers located at or close to a position opposing to the position of the eccentric load due to the uneven distribution of the laundry, whereby the balance of the drum is corrected as a whole. By this washing machine, the eccentricity of the drum as a whole can be lessened in whatever manner the laundry is distributed on the inner peripheral wall of the drum.

Regarding the operation of the above washing machine, however, it is necessary to selectively supply a certain amount of water into proper one or a few water-holding chambers while the drum is rotating. For that purpose, one of the washing machines is provided with plural water supply pipes in the rotation shaft for conveying water to each of the water-holding chamber. Such a water-supplying mechanism, however, is not practical because the structure is very complicated and costly.

In view of the above problem, one object of the present invention is to propose a washing machine having a simple-structured balancing mechanism whereby an unbalance of the drum is cancelled as a whole by adding a weight to the drum for balancing an eccentric load wherever the eccentric load is located on the inner peripheral wall of the drum.

SUMMARY OF THE INVENTION

Thus, in the first aspect of the present invention, the washing machine has a basket-like extraction tub rotatably mounted in an outer tub, and the extraction tub is rotated at a high speed with the laundry loaded therein to extract a washing liquid (water or solvent) from the laundry by a centrifugal force. Further, according to the first aspect of the invention, the washing machine includes:

- a plurality of water-holding chambers provided around a rotation axis of the extraction tub for holding water inside by the centrifugal force;
- a water supplier for supplying water to the water-holding chambers without contacting them;
- a rotation controller for controlling a motor for driving the extraction tub;

- an eccentric load detector for detecting a position of an eccentric load due to an uneven distribution of the laundry in the extraction tub; and
- an operation controller for controlling the water supplier and the rotation controller: to fill the water-holding chambers with a substantially equal amount of water while rotating the extraction tub at a preset speed; and to temporarily reduce the speed of the extraction tub at a time point determined corresponding to the position of the eccentric load to decrease the amount of water held in one or some of the water-holding chambers located at or close to the position of the eccentric load.

The problem of the above conventional washing machine is that water should be selectively and properly supplied to one or a few water-holding chambers according to the position of the eccentric load. According to the first aspect of the present invention, on the other hand, the water-holding chambers are first filled with substantially equal amounts of water, and then the amount of water in one or a few water-holding chambers are selectively reduced by discharging a part of the water. Even while the drum is rotating, it is relatively easy to supply water equally to all the water holding chambers of the drum. The speed of the drum is determined so that the water is held in the water-holding chamber by the centrifugal force. It is possible to let the water in a certain water-holding chamber or chambers spill out by controlling the speed of the drum so that the centrifugal force is decreased.

The washing machine works as follows. When all the water-holding chambers are empty, the extraction tub is rotated at a speed where the centrifugal force acting on the laundry is greater than the gravitational force. Then, the eccentric load detector detects the magnitude and position of the eccentric load due to the uneven distribution of the laundry. When the eccentric load is large, the operation controller rotates the extraction tub at a speed where the centrifugal force acting on the water held in the water-holding chamber is greater than the gravitational force and supplies an adequate amount of water into each of the water-holding chambers. By designing the water-holding chamber to have the same capacity, all the waterholding chambers can contain with almost equal amounts of water when the chambers are fully charged. It is hereby probable that the extraction tub has a large eccentric load. In this case, in order to prevent a large vibration, it is preferable to set the speed as low as possible so long as the above condition is met.

After filling all the water-holding chambers with water, the operation controller commands the rotation controller to temporarily reduce the speed so that a part of the water in the water-holding chamber located at or close to the detected position of the eccentric load spills out. In detail, the speed is reduced at a time point where such chamber (the target chamber) comes to the top of the rotation. As the amount of water in the target chamber decreases, the weight of water at the position decreases, and the eccentricity of the extraction tub decreases as a whole.

In a mode of the above washing machine, the extraction tub is a drum rotatable about a horizontal axis. In this mode, the water-holding chambers may be box-like members located around the horizontal axis. Each water-holding chamber has an opening in its inward face, and the water supplier discharges water to the opening of one of the water-holding chambers which is then at the bottom of the rotation.

While the drum is rotated at a speed where the centrifugal force acting on the water in the water-holding chamber is greater than the gravitational force, the water supplier discharges water to a water-holding chamber then passing the bottom of the rotation. As the rotation proceeds, the water-holding chamber is lifted, and the water inside is pressed onto the outer wall of the inner space of the chamber by a centrifugal force. Thus, the water is prevented from spilling out from the water-holding chamber even when the opening is directed downward. When the drum is decelerated, the water held by the water-holding chamber then located at the top of the drum at the time point spills out from the opening. Thus, the amount of water held by any of the water-holding chambers can be decreased as desired.

In another mode of the above washing machine, the extraction tub is constructed as a wash-and-extraction tub having a pulsator at its bottom. The wash-and-extraction tub and the pulsator are rotatable about a common tilted axis. In this mode, the water-holding chamber may be constructed as a ring-shaped hollow body placed at the upper end of the wash-and-extraction tub. The hollow body is partitioned into a plurality of chambers each of which has an inlet opening in its upper face and an outlet opening in its lower face of the inner part of the hollow body. The water supplier pours water through the inlet opening into the chamber.

While the drum is rotated at a speed where the centrifugal force acting on the water in the water-holding chamber is greater than the component of gravitational force acting on the water in the radial direction of the ring-shaped hollow body, water is discharged from the water supplier. The water enters the water-holding chamber passing at the water-discharging point at the time point. In the water-holding chamber, the water is pressed onto the inner wall of the chamber by the centrifugal force. Thus, the water is prevented from being discharged from the outlet opening. When the tub is decelerated, the water held by a water-holding chamber that is located at the top of the rotation of the tub is spread by the gravitational force and is discharged from the outlet opening. Thus, the amount of water held by any of the water-holding chambers can be decreased.

In the second aspect of the present invention, the washing machine has a basket-like extraction tub rotatably mounted in an outer tub, and the extraction tub is rotated at a high speed with the laundry loaded therein to extract a washing liquid from the laundry by a centrifugal force. Further, according to the second aspect of the invention, the washing machine includes:

- a balancer constructed as a ring-shaped hollow body with a liquid contained therein, where the hollow body is placed surrounding the rotation axis of the extraction tub and is partitioned into a plurality of compartments communicating with each other via a passage extending along the inner circumference of the hollow body;
- a rotation controller for controlling a motor for driving the extraction tub;
- an eccentric load detector for detecting a position of an eccentric load due to an uneven distribution of the laundry in the extraction tub; and
- an operation controller for controlling the rotation controller: to fill the compartments of the balancer with a substantially equal amount of the liquid by rotating the extraction tub at a preset speed; and to transfer a part of the liquid held in one of the compartments to another compartment by temporarily reducing the speed of the extraction tub at an appropriate time point corresponding to the position of the eccentric load.

According to the second aspect of the present invention, the washing machine is equipped with a balancer constructed as a ring-shaped hollow body in which a plurality of compartments are formed communicating with each other at the inner side. At first all the water-holding chambers are equally filled with water, and then a part of the water is transferred from one or plural water-holding chambers to one or some of the other water-holding chambers according to the eccentric load. By such a construction, there is no need to supply water from outside into the water-holding chamber.

The operation controller first controls the rotation controller to rotate the extraction tub at or close to a speed where the centrifugal force acting on the liquid in the compartment is substantially balanced with the gravitational force. In this process, the liquid moves from one compartment to another because the centrifugal force is not large enough to press the liquid onto the outer wall of the inside of the compartments. As a result, the compartments are filled with a substantially equal amount of the liquid. Under such a condition, the eccentric load of the balancer can be ignored, so that the eccentric load detector detects the magnitude and position of an eccentric load due only to an uneven distribution of the laundry. When the eccentric load is large, the operation controller commands the rotation controller to temporarily reduce the speed of the extraction tub so that a part of the liquid held by a first compartment located at or close to the eccentric load is made to flow out of the first compartment into a second compartment in opposition to the first compartment. That is, for example, the speed is temporarily reduced at a time point when a target compartment (first compartment) arrives at the top of the rotation. As a result of transferring the liquid as described above, the weight balance of the liquid changes, so that the eccentricity of the extraction tub as a whole decreases.

As in the first aspect of the invention, the washing machine according to the second aspect of the present invention may be constructed either as a drum-type washing machine having a drum rotatable about a horizontal axis or as a whirlpool-type washing machine having a wash-and-extraction tub rotatable about a tilted axis.

In comparison to the above-mentioned conventional washing machines, the construction of the washing machine according to the present invention is simplified because there is no need to use a complicated water-supplying mechanism for selectively supplying a proper amount of water to the water-holding chambers. Further, according the present invention, even when the laundry is unevenly distributed on the inner peripheral wall of the extraction tub, the balance of the extraction tub can be corrected by decreasing the amount of water held by one or a few water-holding chambers located at or close to the position of the eccentric load. Thus, the balance is corrected within a very short time period.

BRIEF DESCRIPTION OF THE DRAWINGS

FIG. 4 shows the construction of the electrical system of the washing machine of the first embodiment.

FIGS. 5A and 5B show waveform diagrams for explaining a process of detecting eccentric load.

DETAILED DESCRIPTION OF A PREFERRED EMBODIMENT

First Embodiment

The first embodiment of the washing machine according to the present invention is described referring to FIGS. 1–7. The washing machine of the first embodiment is a drum-type washing machine.

Figure 1:
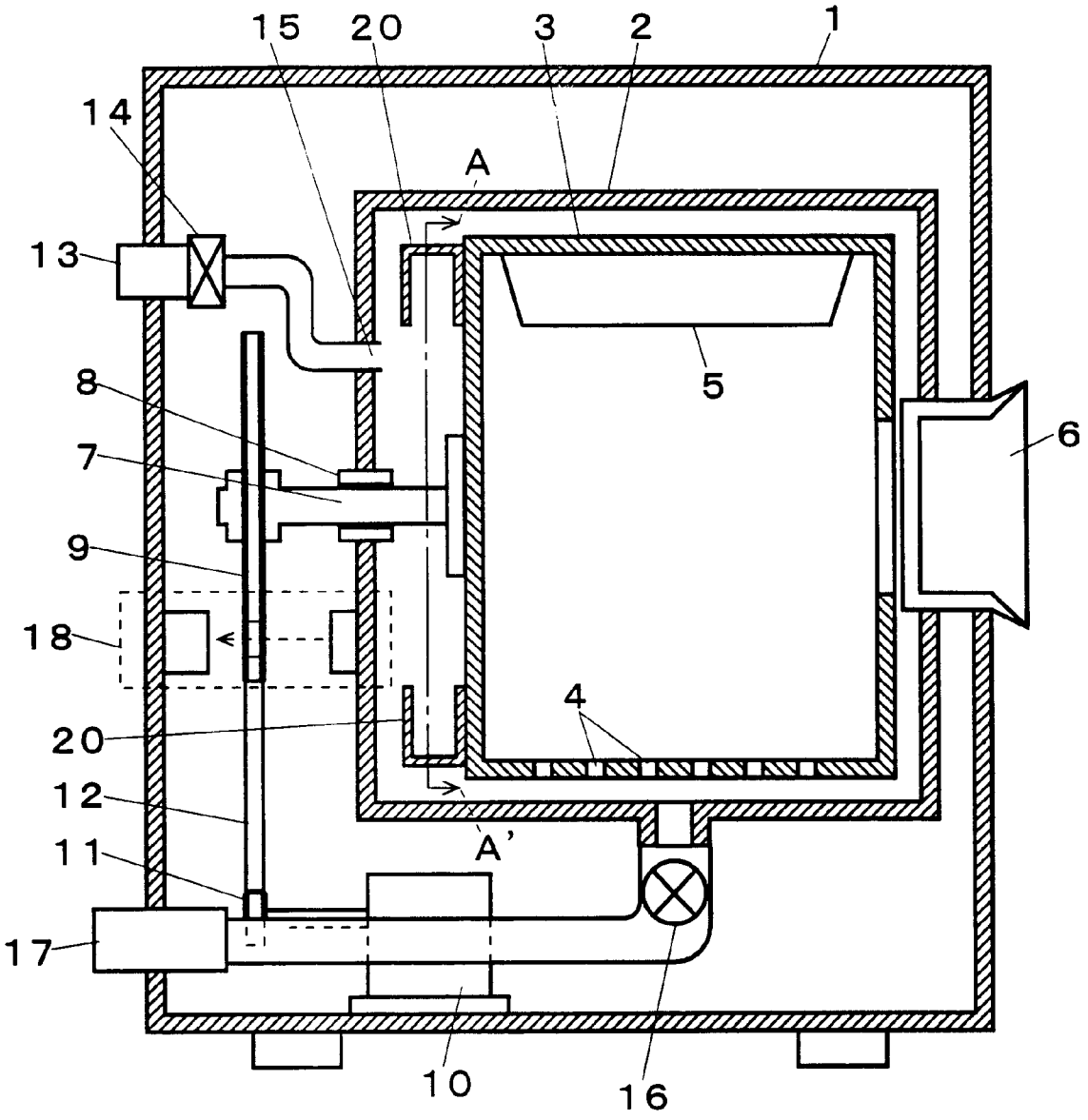
FIG. 1 shows a vertical section of a drum-type washing machine, the first embodiment of the present invention.

FIG. 1 shows a vertical section of the drum-type washing machine of the first embodiment. The washing machine has a body housing 1, in which a cylindrical outer tub 2 is placed. In the outer tub 2, a cylindrical drum 3 for containing the laundry is mounted on a main shaft 7. The drum 3 has a front opening for loading the laundry inside, and a door 6 is provided for closing the front opening. A baffle (or baffles) 5 for lifting the laundry is attached to the inner peripheral wall of the drum 3. A number of perforations 4 are formed in the peripheral wall of the drum 3. In a washing operation or rinsing operation, when water is supplied into the outer tub 2, the water flows through the perforations 4 into the drum 3. In an extracting operation, water extracted from the wet laundry is discharged from the perforations 4 to the outer tub 2.

The main shaft 7 is rotatably held by a bearing 8 fixed in the outer tub 2. A main pulley 9 is attached to the rear end of the main shaft 7. A motor 10 is placed at the bottom of the body housing 1, and a motor pulley 11 is attached to the rotation shaft of the motor 10. The rotation of the motor pulley 9 is transmitted via a V-belt 12 to the main pulley 9. A pipe connection port 13 is provided at the back of the body housing 1, to which a water supply pipe (not shown) extending from an external water tap (not shown) is connected. Water supplied via the water supply pipe flows through a water supply valve 14 and is discharged into the outer tub 2 from a water-discharge port 15 placed at the back of the outer tub 2. Water collected in the outer tub 2 is drained through a drain port 17 to the outside when a drain valve 16 is opened.

A rotation sensor 18 consists of a photo-emitter attached to the rear side of the outer tub 2 and a photo-detector attached to the inside of the rear wall of the body housing 1. The photo-emitter and the photo-detector are placed to face with each other across the main pulley 9. An opening is formed in the rim part of the main pulley 9 at a position such that light emitted from the photo-emitter travels through the opening and reaches the photo-detector once in every rotation of the drum 3. Receiving the light, the photo-detector generates pulse signals (which will be described later) synchronized with the rotation of the drum 3. It should be noted that the rotation sensor 18 may be differently constructed. For example, the rotation sensor 18 may be constructed using a magnetic sensor.

Figure 2:
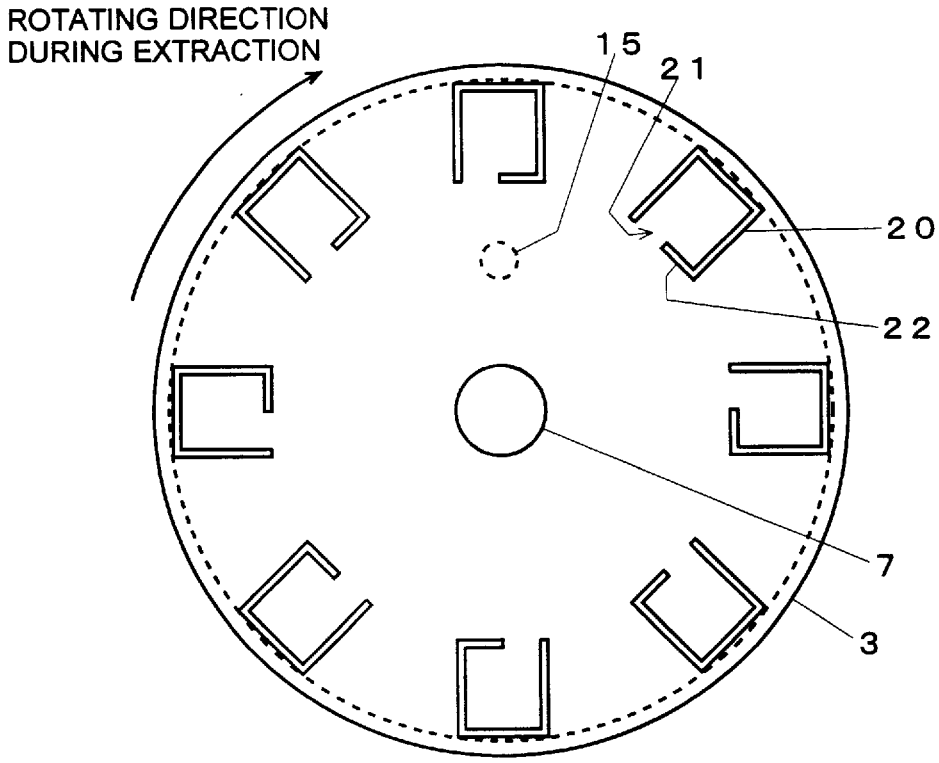
FIG. 2 shows a section of a part of the washing machine at line A–A' in FIG. 1.
Figure 3:
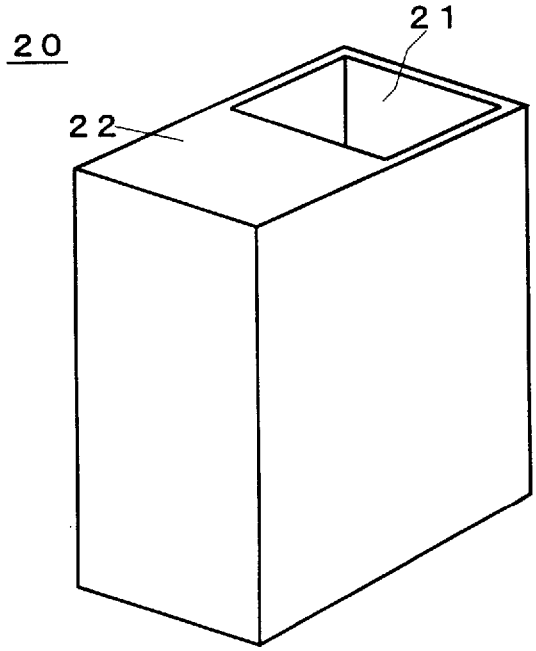
FIG. 3 shows a perspective view of a water-holding chamber used in the washing machine of the first embodiment.

FIG. 2 shows a section of a part of the washing machine at line A–A' of FIG. 1. At the back of the drum 3, eight water-holding chambers 20 are located around the main axis 7 at angular intervals of about 45 degrees. FIG. 3 shows a perspective view of the water-holding chamber 20. The water-holding chamber 20 is a box-shaped hollow body. One side of the chamber 20 has an opening 21 that covers about a half of the side and a blockade wall 22 that covers the other half of the side. As shown in FIG. 2, each of the water-holding chambers 20 is attached to the drum 3 so that the blockade wall 22 comes ahead of the opening 21 when the drum 3 is rotated in the extracting operation. The reason for this will be explained later.

FIG. 4 is a block diagram showing the construction of the electrical system of the present washing machine. A microcomputer 30 for controlling the whole process includes a central processing unit (CPU) 34, an analogue-to-digital (A/D) converter 35, a random access memory (RAM) 36 and a read-only memory (ROM) 37. An operation program for carrying forward a washing process is stored beforehand in the ROM 37. An operation unit 40, a display unit 41, a valve driver 42, an inverter controller 43, a motor current detector 44 and other elements are connected to the microcomputer 30. The operation unit 40 has an operation panel placed at the front side of the body housing 1. When a user makes an operation on the operation panel, the operation unit 40 sends a signal indicative of the operation to the microcomputer 30. The display unit 41 includes a display panel placed at the front side of the body housing 1. The display unit 41 shows information relating to the operation by the user and/or the status of operation on the display panel.

The microcomputer 30 functionally includes a speed controller 31 and an eccentric load detector 32. The speed controller 31 sends a speed-designating signal to the inverter controller 43. The inverter controller 43 converts the signal to a pulse-width-modulation (PWM) signal and applies a driving voltage corresponding to the PWM signal to the motor 10. The motor 10 rotates at a designated speed, and the drum 3 rotates at a reduced speed determined by a preset reduction ratio. The motor current detector 44 detects a torque current component contained in the driving current supplied to the motor 10 by the inverter controller 43.

In general, when the laundry is unevenly distributed on the inner peripheral wall of the drum 3, the load torque changes in the course of one rotation of the drum 3. Accordingly, the torque current component changes corresponding to the eccentric load due to an uneven distribution of the laundry. FIGS. 5A and 5B show an example of waveforms of a train of rotation pulse signals produced by the rotation sensor 18 and of a torque current component changing due to an eccentric load. In each rotation of the drum 3, the maximum peak $V_{max}$ of the torque component appears at a time point when the load torque is maximized.

The load torque is maximized at a time point when the laundry causing the eccentric load is being lifted against the gravitational force toward the top of the drum 3. Therefore, in general, the maximum peak $V_{max}$ appears when the eccentric load is within the angular range of about 90 degrees behind the top of the drum 3. The position of the eccentric load on the inner peripheral wall of the drum 3 may be represented by a phase angle of the maximum peak $V_{max}$ (or of the minimum peak $V_{min}$) within the angular range of 0–360 degrees, where the angle 0 corresponds to the pulse signal.

The difference between the maximum peak value and the minimum peak value ($V_{max}$–$V_{min}$), or the wave height of the torque current component, reflects the magnitude of eccentric load (or amount of eccentricity). The relation between the amount of eccentricity and the wave height of the torque current component is investigated beforehand, and a reference value is predetermined so that an amount of eccentricity at a time point can be evaluated by comparing the wave height of the torque component at the time point to the reference value. For example, receiving waves as shown in FIG. 5B from the motor current detector 44, the eccentric load detector 32 detects the maximum peak $V_{max}$ and the minimum peak $V_{min}$ within one rotation of the drum 3, calculates the wave height by subtracting the latter from the former and determines whether the amount of eccentricity is less than the upper limit value by comparing the wave height to the reference value.

Figure 6:
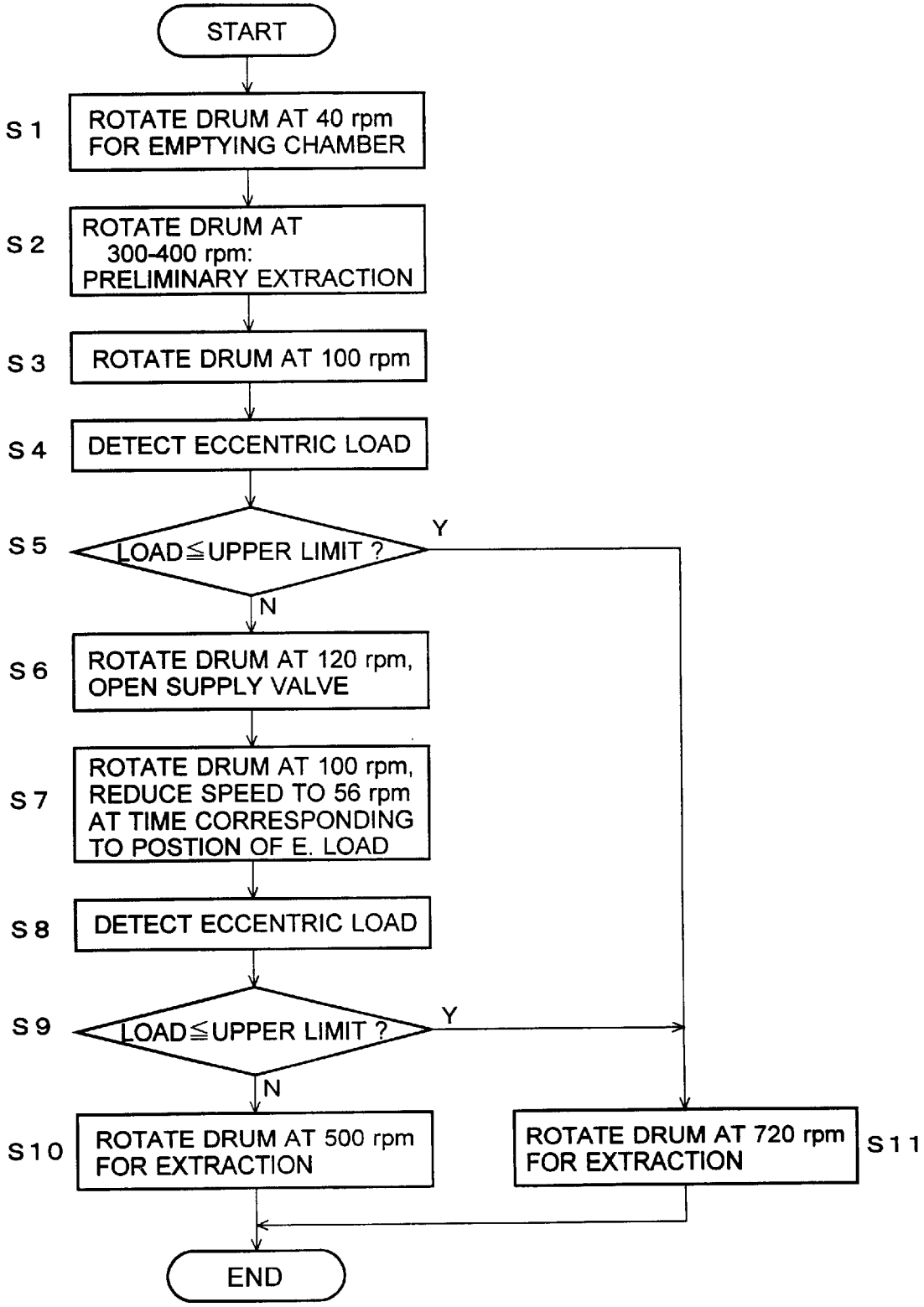
FIG. 6 shows a flowchart of control steps of an extracting operation by the washing machine of the first embodiment.

The drum-type washing machine of the present embodiment is featured by the extracting operation carried out after the washing operation and the rinsing operation. In particular, the washing machine is featured by a method of canceling a load unbalance due to an uneven distribution of the laundry at the start of the extracting operation. Referring to FIG. 6, the extracting operation is described. FIG. 6 shows a flowchart of control steps of the extracting operation.

After starting the extracting operation, the speed controller 31 controls the rotation of the motor 10 through the inverter controller 43 so that the drum 3 is rotated at about 40 r.p.m. (Step S1). At the beginning of the extracting operation, it is probable that water supplied into the outer tub 2 in the washing operation or rinsing operation remains in the water-holding chambers 20. The above speed of the drum 3 is such where the centrifugal force acting on the water in the water-holding chamber 20 is less than the gravitational force. Therefore, the water held in a water-holding chamber 20 is discharged from the opening 21 due to the gravitational force when the water-holding chamber 20 is located at the top of the rotation. Thus, by rotating the drum 3 at the above speed, all the water-holding chambers 20 are almost emptied.

Next, the speed controller 31 controls the rotation of the motor 10 so that the drum 3 is rotated at a speed of 300–400 r.p.m. (Step S2). This speed is such where water held by the laundry in the drum 3 is extracted moderately by a centrifugal force. Also, at that speed, an abnormally large vibration of the drum 3 and the outer tub 2 hardly arises so long as the eccentric load due to an uneven distribution of the laundry is of a normally expectable magnitude. By this operation, the laundry water is preliminarily extracted. Such a preliminary extraction is effective for suppressing an increase in the magnitude of and a change in the position of the eccentric load that may arise in the extracting operation due to a difference in the dehydration rates of laundry articles.

Next, the speed controller 31 reduces the speed of the drum 3 to 100 r.p.m. and keeps at that speed (Step S3). At this speed, the centrifugal force acting on the laundry is greater than the gravitational force, so that the laundry is pressed onto the inner peripheral wall of the drum and rotates with the drum 3. Under such a condition, the eccentric load detector 32 detects the magnitude of the eccentric load (i.e. amount of eccentricity) and the position of the eccentric load on the inner peripheral wall of the drum 3 based on the torque current component detected by the motor current detector 44 (Step S4). After that, the eccentric load detector 32 determines whether the amount of eccentricity is less than an upper limit value (Step S5). The upper limit value is preset taking account of the magnitude (amplitude) of vibration to be allowed in the high-speed extracting operation (described later) and other factors.

In Step S5, when the amount of eccentricity is less than the upper limit value, there is no need to correct the balance. Therefore, the speed controller 31 raises the speed of the drum 3 to about 720 r.p.m. and keeps at that speed (Step S11).

In Step S5, when, on the other hand, the amount of eccentricity is greater than the upper limit value, a balancing operation is carried out as follows. First, the speed controller 31 raises the speed of the drum 3 to about 120 r.p.m., and opens the water supply valve 14 through the valve driver 42 (Step S6). Then, the water supplied through the water supply pipe is discharged from the water-discharge port 15. In front of the water-discharge port 15, the water-holding chambers 20 are rotating together with the drum 3. When a water-holding chamber 20 passes the bottom of the rotation, the water discharged from the water-discharge port 15 enters the water-holding chambers 20 through its opening 21. When the drum speed is about 120 r.p.m., the centrifugal force acting on the water in the water-holding chamber 20 is greater than the gravitational force. Therefore, the water is urged toward the outside wall of the water-holding chamber 20 and is held inside, being prevented from spilling out of the opening 21.

The above-described operation is continued for a preset time period. As a result, all the water-holding chambers 20 are filled with water. Under such a condition, the eccentric load due to the water is almost zero because the water-holding chambers 20 have the same capacity and they are located at substantially equal angular intervals around the main shaft 7. The laundry, on the other hand, is pressed onto the inner peripheral wall of the drum 3 by the centrifugal force, so that the eccentric load due to the uneven distribution of the laundry does not change during the above-described operation. Thus, the eccentricity of the drum 3 as a whole is hardly influenced by the water.

After that, the rotation of the drum 3 is controlled so that the water held by one or some of the water-holding chambers 20 located at or close to the position of the eccentric load detected as described above spills out from the water-holding chamber(s) 20. That is, while the drum 3 is rotated at a speed where the centrifugal force acting on the water in the water-holding chamber 20 is greater than the gravitational force, the speed is temporarily reduced to a speed where the centrifugal force is less than the gravitational force. Then, part of the water held by a water-holding chamber 20 that is located at the top of the drum 3 spills out from the chamber 20. Here, if the water spilled from one water-holding chamber 20 should enter one or some of the other chambers 20, particularly a neighboring one, it is difficult to correct the balance later on. Accordingly, in the washing machine of the present embodiment, the water-holding chamber 20 is provided with the blockade wall 22, which comes ahead of the opening 21 in the course of the rotation.

Figure 7A:
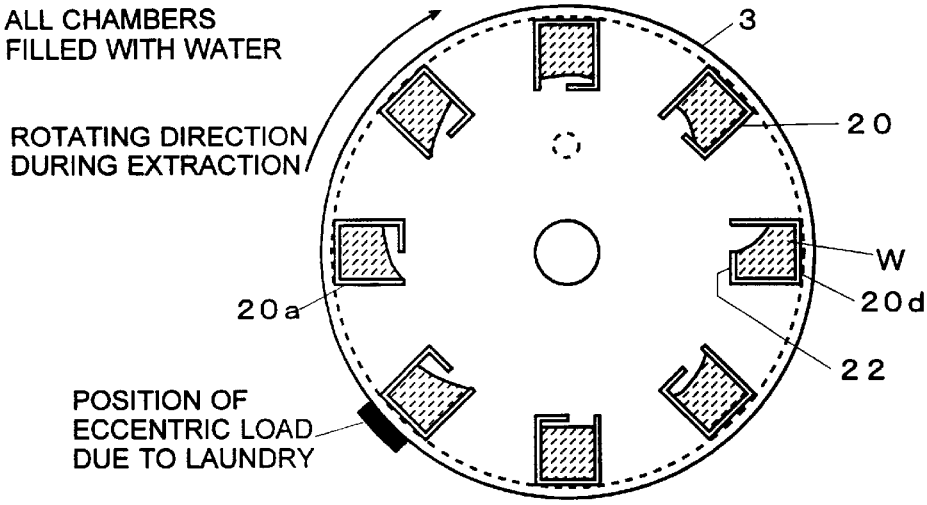
FIGS. 7A–7C show the state of water held by the water-holding chambers during a balance-correcting operation by the washing machine of the first embodiment.
Figure 7B:
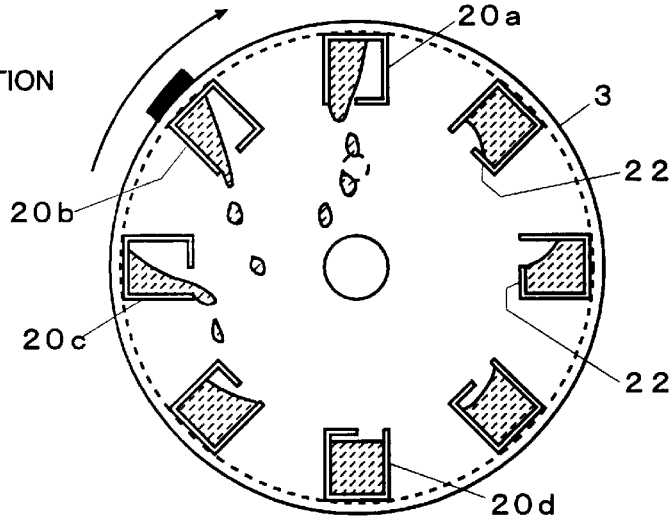
Figure 7C:
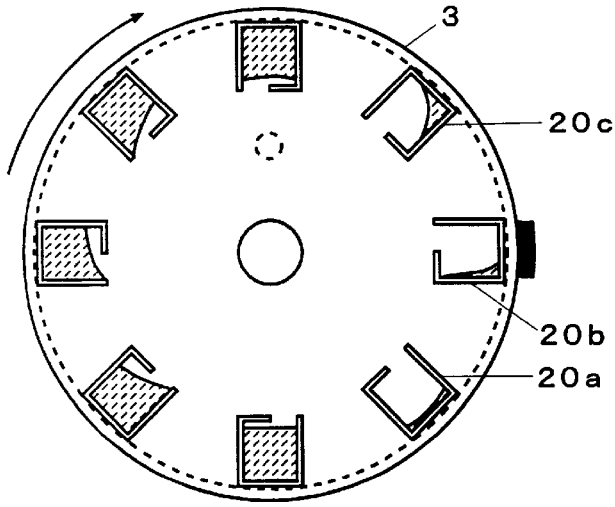

FIGS. 7A–7C show the state of the water held by the water-holding chambers 20 during the rotation. When the drum 3 is rotated at 100 r.p.m., the water is in a state as shown in FIG. 7A since the gravitational force is acting on the water. In FIG. 7A, when a water-holding chamber is being lifted toward the top of the rotation, as denoted by numeral 20*a*, the water held by the chamber is easy to spill. When, on the other hand, a water-holding chamber is moving downwards after passing the top of the rotation, as denoted by numeral 20*d*, the water held by the chamber is hard to spill because the blockade wall 22 prevents the water from spilling. Therefore, when the speed is temporarily reduced as described above, part of the water held by the water-holding chambers 20*b*, 20*c* being lifted toward the top of the rotation and by the water-holding chamber 20*a* being at the top of the rotation at that time point is discharged, and the water held by the water-holding chamber moving toward the bottom of the rotation (chamber 20*d*, for example) is not discharged but held as is.

When the rotation speed is rapidly reduced, an inertial force acts on the water held in the water-holding chamber 20, whereby the water spilled out from the chamber 20 is scattered forward. Therefore, the probability of the scattered water's entering other water-holding chambers passing below is small and, even if it should happen, the amount of water entering the chambers is indeed small.

In the balance correcting operation, it is necessary to spill the water from the water-holding chambers without causing a movement of the laundry in the drum 3. In the washing machine of the present embodiment, the water-holding chambers 20 are placed closer to the main shaft 7 than the inner peripheral wall of the drum 3. By this construction, when the drum is rotated at a certain speed, the laundry lying on the inner peripheral wall of the drum 3 undergoes a centrifugal force greater than that which acts on the water held in the water-holding chamber 20. Further, it is generally known that the wet laundry on the inner peripheral wall of the drum is harder to fall off than expected from the calculation relating to the balance between the centrifugal force and the gravitational force, because the water in the laundry increases the stickiness of the laundry on the wall. Thus, it is possible to let the water fall off while preventing the laundry from falling off by appropriately determining the drum speed at about a speed where the centrifugal force is balanced with the gravitational force.

In the present embodiment, the speed controller 31 rotates the drum 3 at 100 r.p.m., a speed where the laundry is softly pressed onto the inner peripheral wall. Meanwhile, the change in the torque current component as shown in FIG. 5B is monitored, and the position of the eccentric load is recognized by detecting the maximum peak $V_{max}$. After the eccentric load has passed the bottom of the drum 3, the speed is rapidly reduced at a time point determined within a time period where the eccentric load is being lifted (or within an angular range of about 90 degrees behind the top of the rotation, for example). After that, the speed is rapidly restored (Step S7). By such an operation, the water held by the water-holding chamber located at and close to the eccentric load falls off, and the weight at the part accordingly decreases. When the amount of decrease in the weight is as large as to counterbalance the eccentric load due to the uneven distribution of the laundry, the eccentricity of the drum 3 as a whole becomes adequately small.

After the above-described balance correcting operation, the eccentric load is again detected as in Steps S4, S5, and it is determined whether the amount of eccentricity is greater than the upper limit value (Steps S8, S9). When, as a result of the balance correcting operation, the amount of eccentricity is less than the upper limit value, the speed controller 31 raises the speed of the drum 3 to about 720 r.p.m. and keeps at that speed to carry out extraction (Step S11).

When, in Step S9, the amount of eccentricity is greater than the upper limit value, it means that the eccentric load is not completely cancelled by the balance correcting operation. Therefore, the speed of the drum 3 is raised to about 500 r.p.m., a speed where the vibration hardly grows abnormally large even if an eccentric load exists (Step S10). In either of Steps S10 and S11, the drum 3 is stopped when a preset extraction time period has elapsed. Thus, the extracting operation is completed.

In the above description, the balance correcting operation of Step S7 is performed only once, which may be repeated several times.

Second Embodiment

The second embodiment of the washing machine according to the present invention is described referring to FIGS. 8–11. The washing machine of the second embodiment is also a drum-type washing machine.

Figure 8:
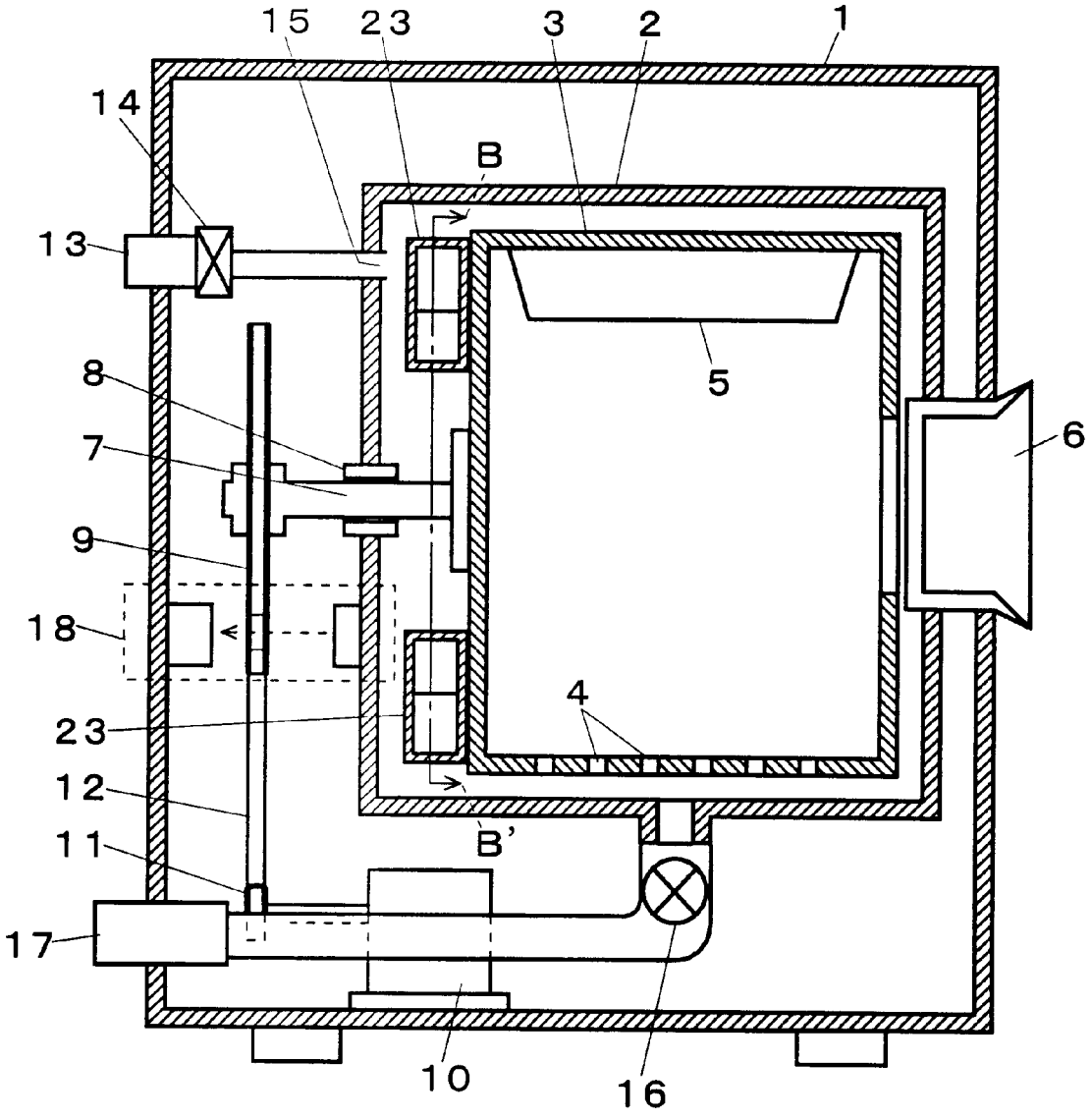
FIG. 8 shows a vertical section of a drum-type washing machine, the second embodiment of the present invention.
Figure 9:
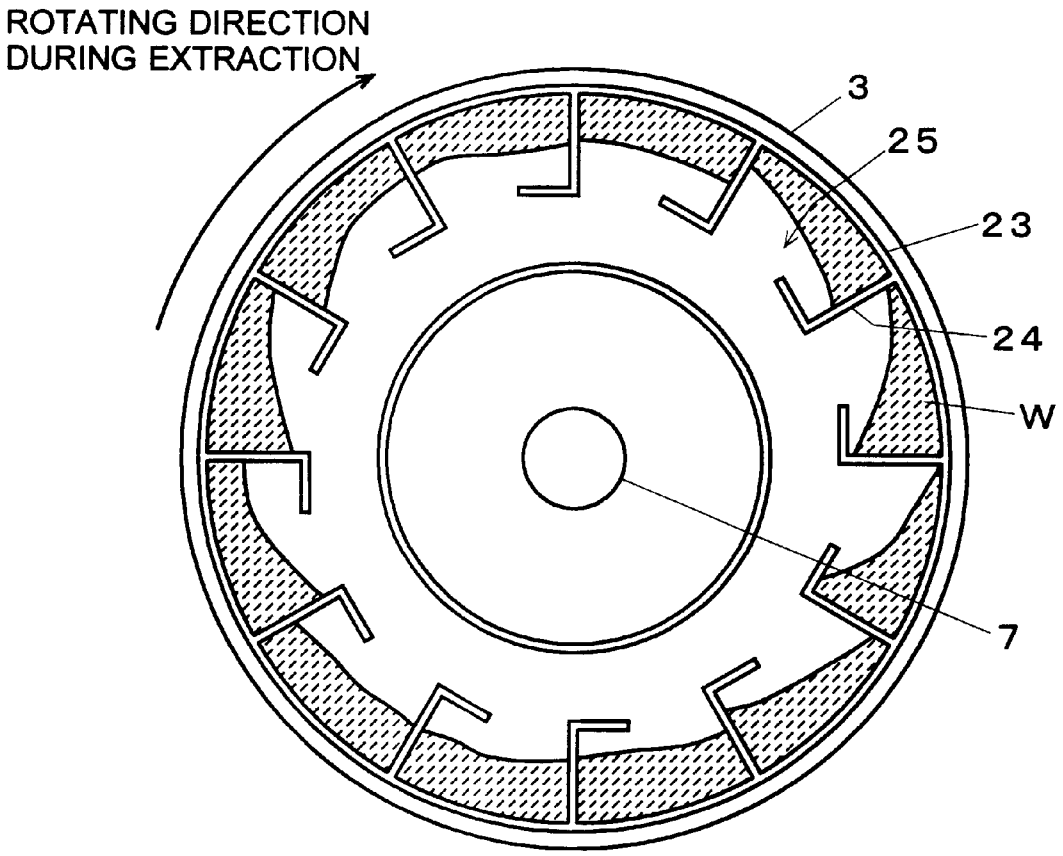
FIG. 9 shows a section of a part of the washing machine at line B–B' in FIG. 8.

FIG. 8 shows a vertical section of the drum-type washing machine of the second embodiment. In the second embodiment, those elements which are identical to the elements of the washing machine of the first embodiment are denoted by the same numerals. Concerning these elements, the description in the first embodiment is also applicable to the second embodiment. The washing machine is equipped with a balancer 23 at the back of the drum 3. The balancer 23 is a ring-shaped hollow body containing a preset amount of water (or other liquid). FIG. 9 shows a section at line B–B' in FIG. 8. The balancer 23 has in its inside plural L-shaped partitions 24 radially located at preset angular intervals and extending from the outer circumference of the balancer 23 inwards. The partitions 24 form plural compartments 25 in the balancer 23, whereby the water is prevented from moving freely in the balancer 23. That is, when the drum 3 is rotated at an adequately high speed, the water is trapped in the compartments 25, being pressed onto the outer wall of the compartments 25. Under such a condition, the water trapped in one compartment 25 cannot move to another compartment 25. The reason for forming the partition 24 into L-shape is the same as that for providing the water-holding chamber 20 with the blockade wall 22 in the first embodiment.

Figure 10:
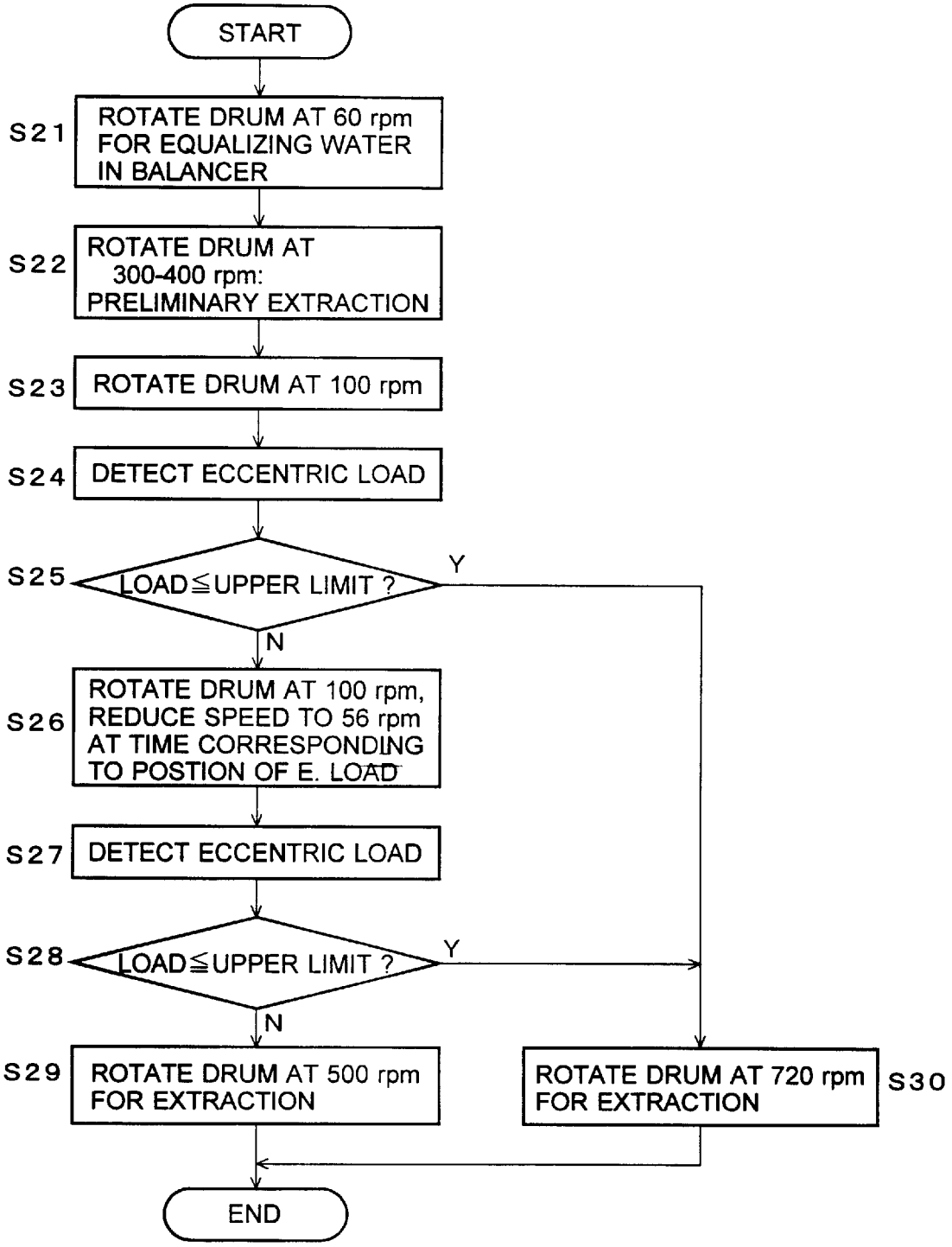
FIG. 10 shows a flowchart of control steps of an extracting operation by the washing machine of the second embodiment.

By the washing machine of the second embodiment, the total amount of the water in the balancer 23 is fixed, and the balance is corrected by changing the distributing ratio of the water among the compartments 25. The electrical system of the washing machine is constructed the same as that of the first embodiment, except for that the control program stored in the ROM 37 is different FIG. 10 shows a flowchart of control steps of the extracting operation. Referring to the flowchart, the control steps of the second embodiment are described particularly focusing on the difference from the control steps of the first embodiment.

At the start of the extracting operation, the speed controller 31 controls the motor 10 through the inverter controller 43 so that the drum 3 is rotated at about 60 r.p.m. (Step S21). This speed is about such where the centrifugal force acting on the water in the balancer is balanced with the gravitational force. When the drum 3 is rotated at such a speed, the water existing in the outer half of the compartment 25 is pressed onto the circumferential wall by the centrifugal force, and the water existing in the inner half of the compartment 25 falls due to the gravitational force and enters one or some of the other compartments 25. By rotating the drum 3 at this speed for a certain time period, the water is distributed almost equally among all the compartments 25. When the water is in such an equalized state, the eccentric load of the balancer 23 is almost zero, so that the eccentricity of the drum 3 as a whole is equivalent to the eccentric load due to the uneven distribution of the laundry.

Next, the process goes through Steps S22–S25, which correspond to Steps S2–S5, where the preliminary extraction of the laundry, the detection of the eccentric load and the determination of the amount of eccentricity are carried out. When the amount of eccentricity is less than an upper limit value, the operation goes to Step S30, where the speed controller 31 raises the speed of the drum 3 to 720 r.p.m. and keeps at that speed.

Figure 11A:
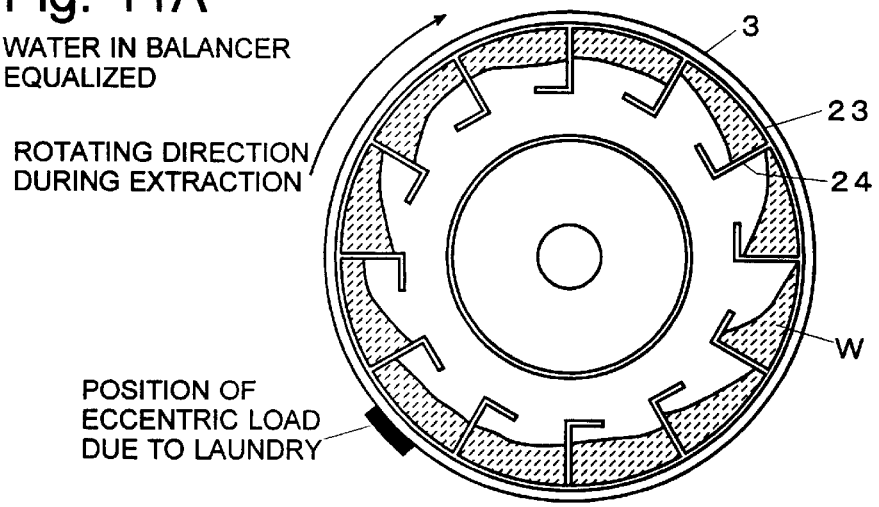
FIGS. 11A–11C show the state of water held by the water-holding chambers during a balance-correcting operation by the washing machine of the second embodiment.
Figure 11B:
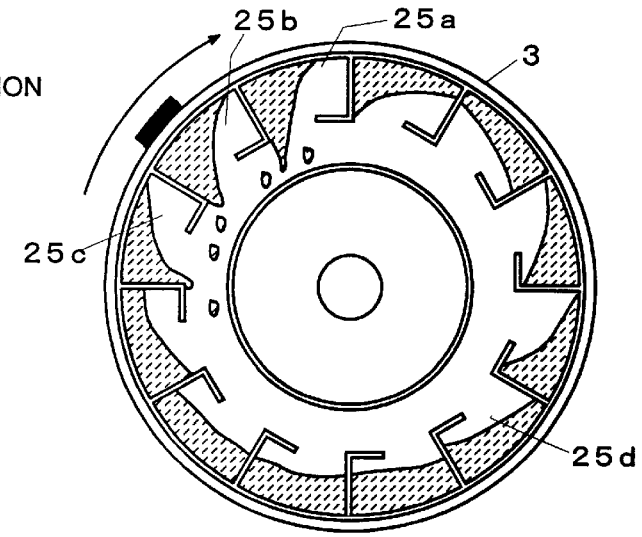
Figure 11C:
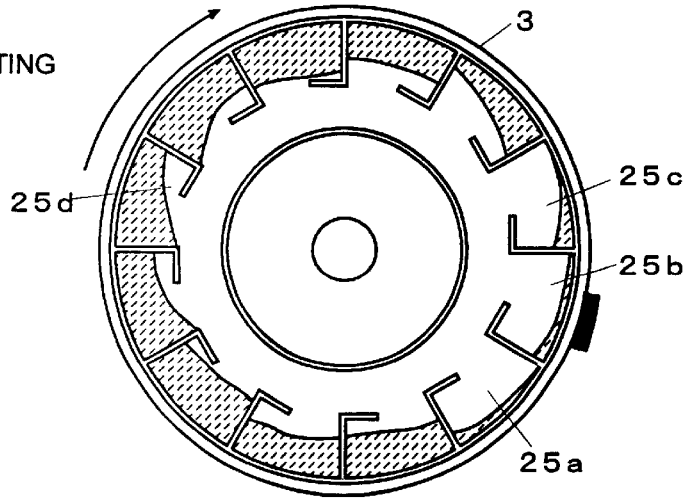

In Step S25, when the amount of eccentricity is greater than the upper limit value, the balance correcting operation is carried out in Step S26 as in Step S7. That is, while the drum 3 is rotated at about 100 r.p.m., the speed of the drum 3 is temporarily reduced to 56 r.p.m. at a time point determined according to the position of the eccentric load. Then, as shown in FIG. 11B, some amount of water falls off the compartments 25*a*, 25*b* and 25*c* that are then being lifted to the top of the drum 3, and most of the water flows into one or some of the compartments located in the opposite side (compartment 25*d*, for example). As a result, the compartments 25*a*, 25*b* and 25*c* located at or close to the position of the eccentric load due to the uneven distribution of the laundry are almost emptied, whereas the amount of water held by the opposing compartments (compartment 25*d* and the neighboring compartments) increases. Thus, the eccentricity of the drum 3 decreases as a whole.

Third Embodiment

In the first and second embodiments, the present invention is applied to a drum-type washing machine having a drum (or wash-and-extraction tub) mounted to rotate about a horizontal axis. The present invention may be applied to other types of washing machines in which a wash-and-extraction tub is mounted in a different manner. In the third and fourth embodiments, the present invention is applied to a whirlpool-type washing machine having a wash-and-extraction tub mounted to rotate about a tilted axis.

Figure 12:
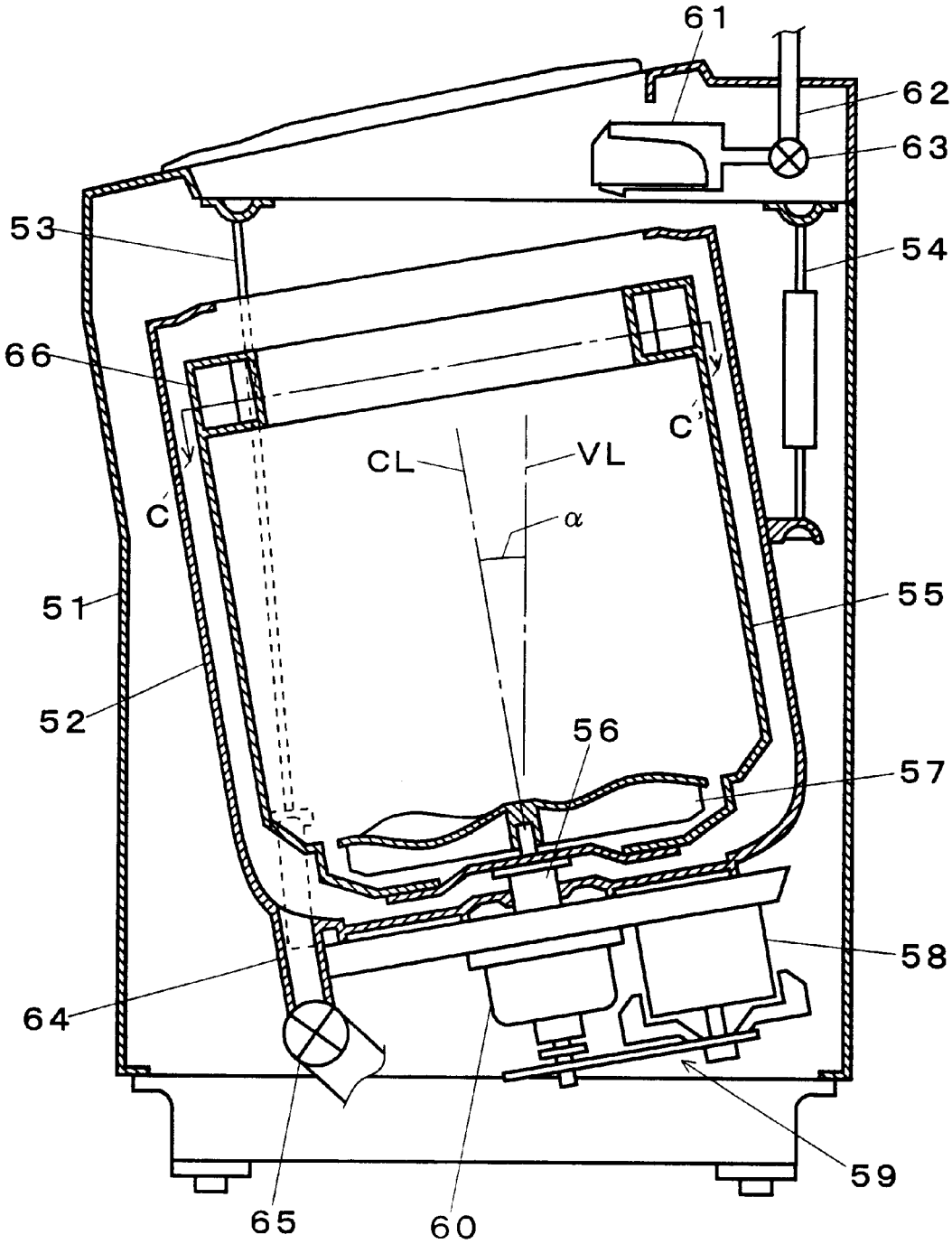
FIG. 12 shows a vertical section of a whirlpool-type washing machine, the third embodiment of the present invention.

FIG. 12 shows a vertical section of the whirlpool-type washing machine of the third embodiment. In a body housing 51 of the washing machine, a cylindrical outer tub 52 is suspended by four suspension rods including two front suspension rods 53 and two rear suspension rods 54 (though FIG. 12 shows only each one of the rods 53, 54) so that it tilts toward the front of the washing machine. The upper part of the front of the body housing 51 is formed to project in accordance with the tilt of the outer tub 52. In the outer tub 52, a wash-and-extraction tub 55 having a number of perforations is rotatably mounted on a main axis 56. A pulsator 57 for agitating the laundry is placed at the bottom of the wash-and-extraction tub 55. A motor 58 is attached to the back face of the bottom of the outer tub 52. The rotation power of the motor 58 is transmitted to the wash-and-extraction tub 55 and/or the pulsator 57 via a transmission mechanism 59 including a motor pulley, a V-belt, a main pulley and a changeover mechanism 60 including a clutch. The changeover mechanism 60 is used to change the rotation mode so that only the pulsator 57 is rotated in one direction or in both directions during the washing operation and/or rinsing operation and that the wash-and-extraction tub 55 and the pulsator 57 are rotated together in one direction during the extracting operation.

In the upper rear part the body housing 51 is placed a water-discharge unit 61 having a detergent container in which detergent to be put into the outer tub 52 is contained. A water supply pipe 62 having a water supply valve 63 is connected to the water-discharge unit 61. When the water supply valve 63 is opened, water flows from an external water tap (not shown) through the water supply pipe 62 into the water-discharge unit 61, and the water is poured from the water-discharge unit 61 into the outer tub 52 below. A drain pipe 64 having a drain valve 65 is connected to the front end of the bottom part (or the lowest part) of the outer tub 52. Though not shown, the other end of the drain valve 64 leads to an external drain via a flexible drain hose.

By the present washing machine, the outer tub 52 and the wash-and-extraction tub 55 are tilted toward the front so that the direction of their open top is diverted off the vertical line. That is, the outer tub 52 is placed so that its central axis CL is tilted by a tilt angle of a from the vertical line VL. Standing before the washing machine, a user can easily look into the wash-and-extraction tub 55 and take out the laundry from it. The title angle a is preferably determined between 5–20 degrees. With such a tilt angle, the user can take out the laundry easily, and the projection of the body housing 51 is adequately suppressed. In the present embodiment, the tilt angle a is set at about 10 degrees.

Figure 13:
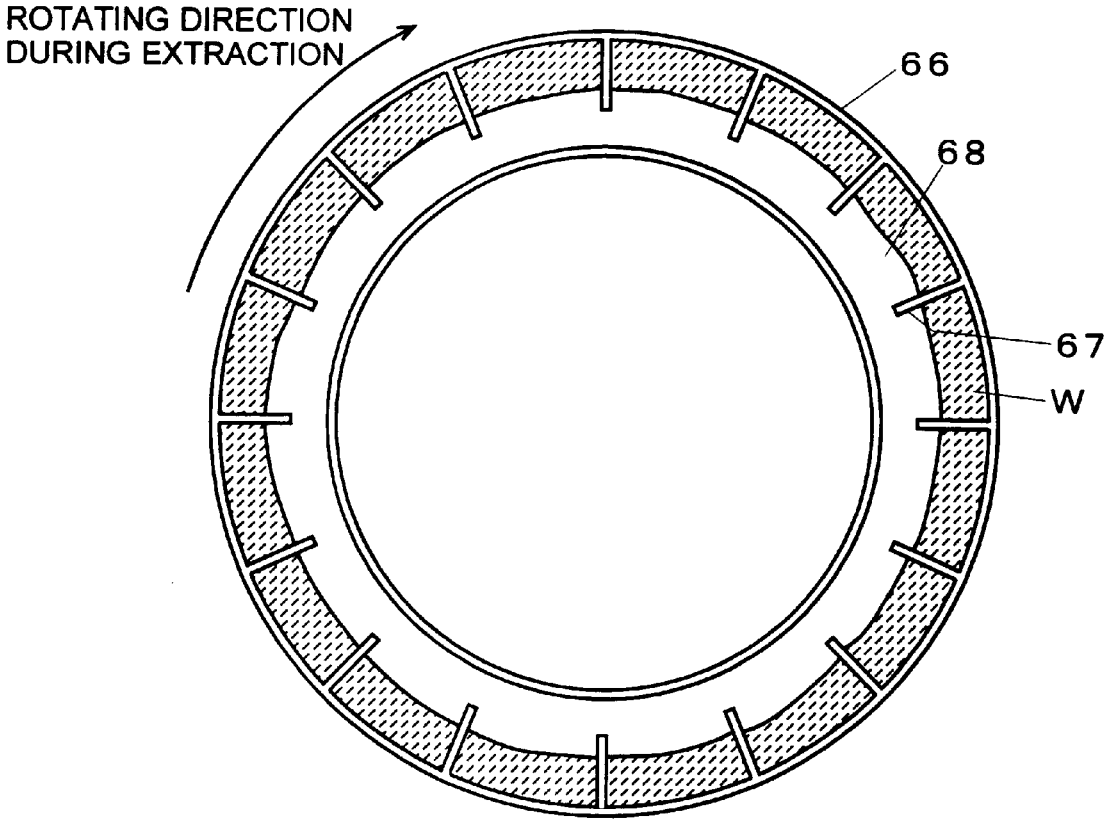
FIG. 13 shows a section of a part of the washing machine at line C–C' in FIG. 12.

The wash-and-extraction tub 55 is equipped with a balancer 66 at its upper end. The balancer 66 is a ring-shaped hollow body containing a preset amount of water (or other liquid). FIG. 13 shows a section at line C–C' in FIG. 12. The balancer 66 has in its inside plural partitions 67 radially located at preset angular intervals and extending from the outer circumference of the balancer 66 inwards. The partitions 67 form plural compartments 68 in the balancer 66, whereby the water W is prevented from moving freely in the balancer 66. That is, when the wash-and-extraction tub 55 is rotated at an adequately high speed, the water W is trapped in the compartments 68, being pressed onto the outer wall of the compartments 68. Under such a condition, the water W trapped in one compartment 68 cannot move to another compartment 68. The inclination of the balancer 66 is so slight that the component of gravitational force acting to transfer the water from a compartment located at the top of the rotation to another compartment located at the bottom of the rotation is not large. So, even when the water flows out of a compartment moving downward, there is little possibility of the water's entering the neighboring compartment in a concentrated manner. Thus, unlike the second embodiment, the partition 67 is not L-shaped in the present embodiment.

The total amount of the water in the balancer 66 is fixed and the balance is corrected by changing the distributing ratio of the water among the compartments 68, as in the second embodiment. That is, first the water in the balancer 66 is equally distributed to all the compartments, and the eccentric load is detected. When the amount of eccentricity is greater than an upper limit value, the speed reduction control is carried out to change the distribution of the water in the balancer 66 according to the position of the eccentric load. Thus, the eccentricity is cancelled as a whole.

Fourth Embodiment

Figure 14:
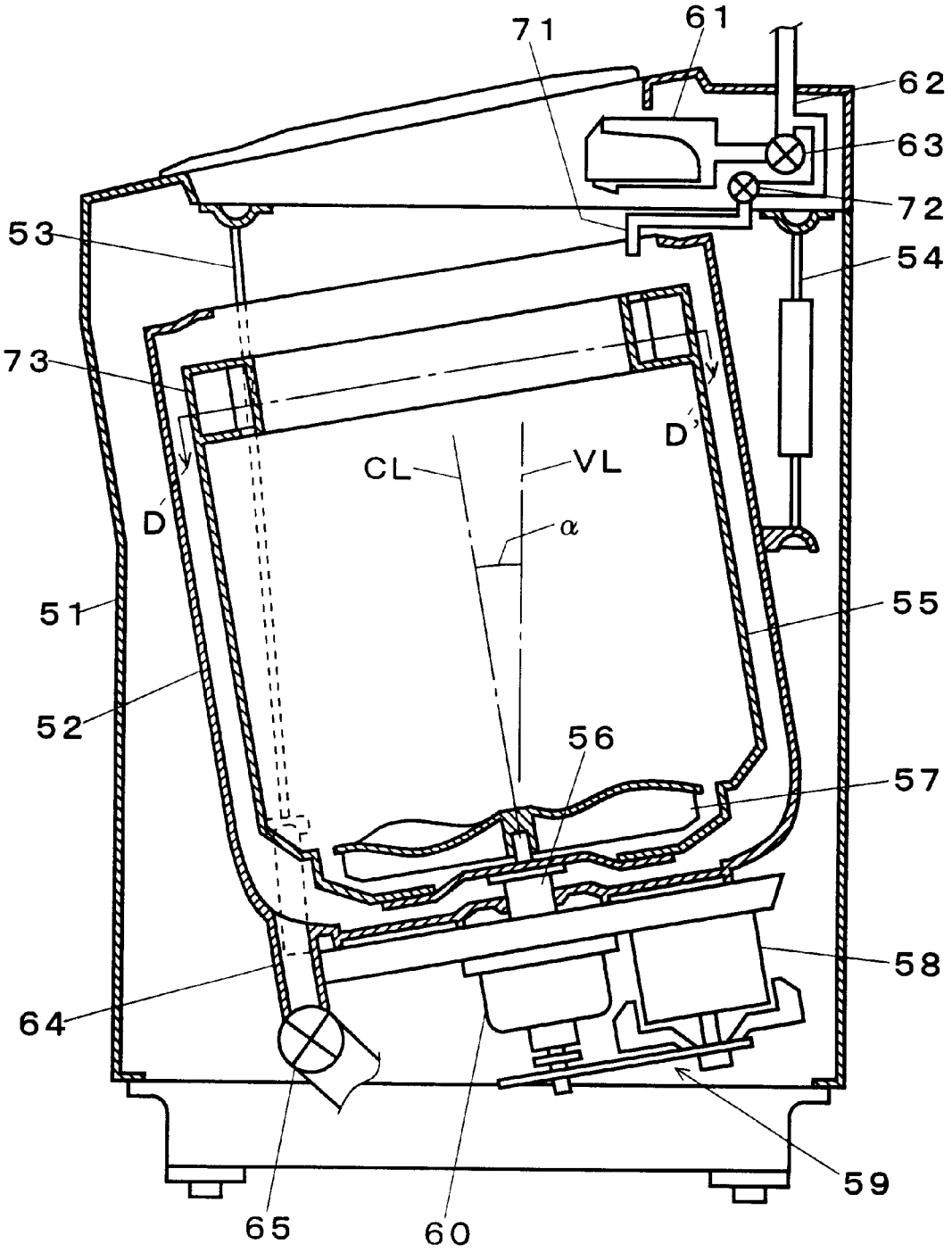
FIG. 14 shows a vertical section of a whirlpool-type washing machine, the fourth embodiment of the present invention.
Figure 15:
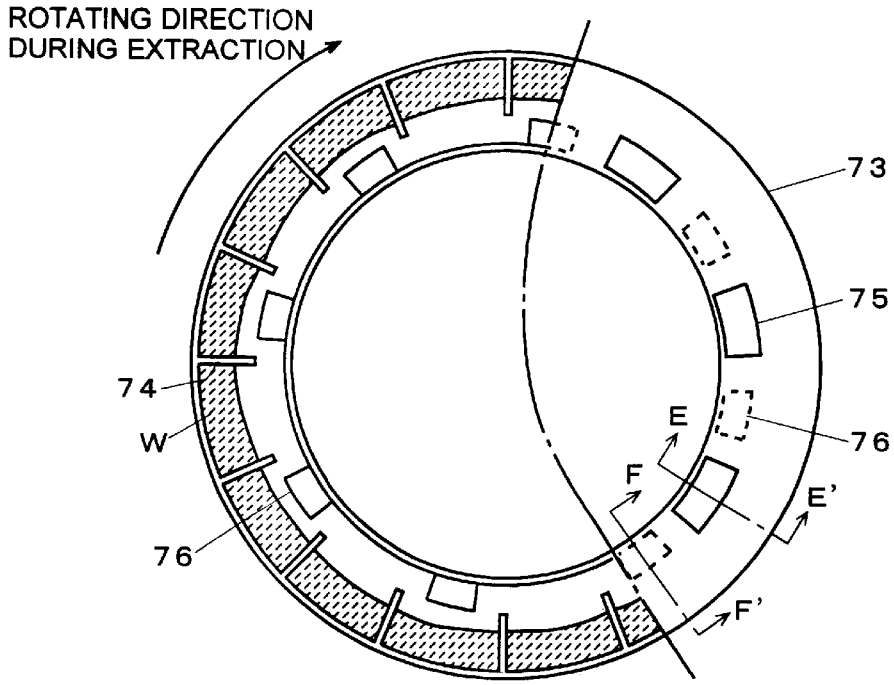
FIG. 15 shows a section of a part of the washing machine at line D–D' in FIG. 14.
Figure 16:
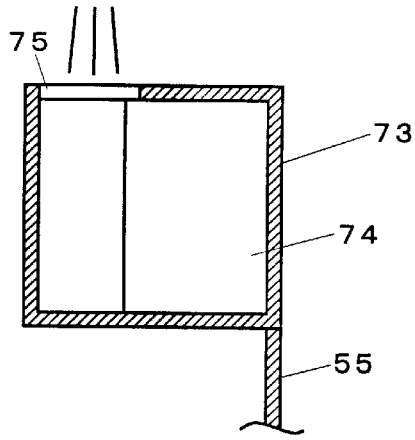
FIG. 16 shows a section of a part of the washing machine at line E–E' in FIG. 15.
Figure 17:
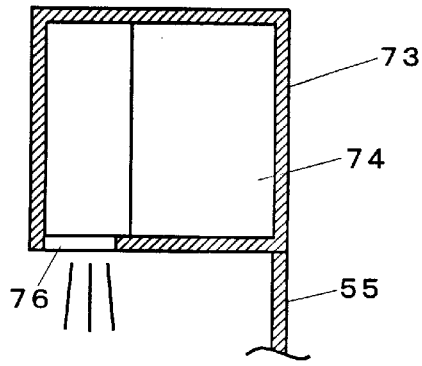
FIG. 17 shows a section of a part of the washing machine at line F–F' in FIG. 15.

The whirlpool-type washing machine shown in FIG. 12 may be modified so that the balance is corrected by supplying water from outside and discharging water by the speed reduction, as in the first embodiment. FIG. 14 shows a vertical section of the whirlpool-type washing machine of the fourth embodiment, FIG. 15 shows the section at line D–D' in FIG. 14, FIG. 16 shows the section at line E–E' in FIG. 15 and FIG. 17 shows the section at line F–F' in FIG. 15. Those elements which are identical to the elements of the washing machine shown in FIG. 12 are denoted by the same numerals. Concerning these elements, the description in the third embodiment is also applicable to the fourth embodiment.

As shown in FIGS. 15–17, the wash-and-extraction tub 55 is equipped with a balancer 73 at its upper end. The balancer 73 is a ring-shaped hollow body in which plural partitions 74 are located, as in the balancer 66. The balancer 73 has inlet openings 75 and outlet openings 76 located alternately in its top and bottom along its inner circumferential side. A balancing-water-supply pipe 71 having a water supply valve 72 is located as shown in FIG. 14 for injecting water through the inlet opening 75 into the balancer 73.

While the wash-and-extraction tub 55 is rotating at a preset speed, when the water supply valve 72 is opened, water is discharged from the balancing-water-supply pipe 71. The water enters the balancer 73 through one of the inlet openings 75 that is then passing below the balancing-water-supply pipe 71. The water W in the balancer 73 is displaced toward the outer circumference by the centrifugal force as shown in FIG. 15, and little or no water is discharged from the outlet opening 76. When the speed of the wash-and-extraction tub 55 is reduced, the centrifugal force acting on the water W decreases. Thus, the water W in the upper part of the balancer 73 starts flowing downward, which is then discharged from the outlet opening 76.

The whirlpool-type washing machine works as follows. First, similar to the drum-type washing machine of the first embodiment, the wash-and-extraction tub 55 is rotated at low speed so that the balancer 73 is emptied, and a preliminary extraction is carried out. When the amount of eccentricity due to the uneven distribution of the laundry is greater than the upper limit value, water is supplied into the balancer 73 until it is filled with the water. After that, the speed of the wash-and-extraction tub 55 is temporarily reduced according to the position of the eccentric load in order to discharge a part of the water in the balancer 73 from the outlet opening 76. After the unbalance of the wash-and-extraction tub 55 around the rotation axis is thus cancelled, the extracting operation is carried out at a higher speed.

The numerical values (speed, angle, etc.) presented in the above embodiments are mere example and do not restrict the scope of the present invention. Though all the above embodiments relate to washing machines using water for washing the laundry, it is obvious that the present invention may be applied to a dry cleaner using a petroleum solvent. When, as in the first and fourth embodiments, a liquid is supplied into water-holding chambers or a balancer from outside, the liquid should be such a liquid that is used in the washing process. When, as in the first and fourth embodiments, a balancer containing a liquid is used, any liquid having an appropriate viscosity may be used.

What is claimed is:

1. A washing machine having a basket-like extraction tub rotatably mounted in an outer tub, the extraction tub being rotated at a high speed with laundry loaded therein to extract liquid from the laundry by a centrifugal force, comprising:

a plurality of water-holding chambers provided around a rotation axis of the extraction tub for holding water inside by the centrifugal force;

a water supplier for supplying water to the water-holding chambers without contacting them;

a rotation controller for controlling a motor for driving the extraction tub;

an eccentric load detector for detecting a position of an eccentric load due to an uneven distribution of the laundry in the extraction tub; and an operation controller for controlling the water supplier and the rotation controller: to fill the water-holding chambers with a substantially equal amount of water while rotating the extraction tub at a preset speed; and to temporarily reduce the speed of the extraction tub at a time point determined corresponding to the position of the eccentric load to decrease the amount of water held in one or some of the water-holding chambers located at or close to the position of the eccentric load.

2. The washing machine according to claim 1, where the extraction tub is a drum rotatable about a horizontal axis.

3. The washing machine according to claim 2, where the water-holding chambers are box-like members located around the horizontal axis, each water-holding chamber having an opening in its inward face, and the water supplier discharges water to the opening of one of the water-holding chambers which is then at a bottom of a rotation.

4. The washing machine according to claim 1, where the extraction tub is a wash-and-extraction tub having a pulsator at its bottom, the wash-and-extraction tub and the pulsator being rotatable about a common tilted axis; rotatable about a tilted axis, and a pulsator whose rotation axis coincides with the tilted axis is disposed at a bottom of the wash-and-extraction tub.

5. The washing machine according to claim 4, where the water-holding chamber is constructed as a ring-shaped hollow body placed at an upper end of the wash-and-extraction tub, the hollow body being partitioned into a plurality of chambers each of which has an inlet opening in its upper face and an outlet opening in its lower face of the inner part of the hollow body, and the water supplier discharges water to the inlet opening.

6. A washing machine having a basket-like extraction tub rotatably mounted in an outer tub, the extraction tub being rotated at a high speed with laundry loaded therein to extract liquid from the laundry by a centrifugal force, comprising:

a balancer constructed as a ring-shaped hollow body with a liquid contained therein, the hollow body being placed surrounding a rotation axis of the extraction tub and partitioned into a plurality of compartments communicating with each other via a passage extending along an inner circumference of the hollow body;

a rotation controller for controlling a motor for driving the extraction tub;

an eccentric load detector for detecting a position of an eccentric load due to an uneven distribution of the laundry in the extraction tub; and an operation controller for controlling the rotation controller: to fill the compartments of the balancer with a substantially equal amount of the liquid by rotating the extraction tub at a preset speed; and to transfer a part of the liquid held in one of the compartments to another compartment by temporarily reducing the speed of the extraction tub at an appropriate time point corresponding to the position of the eccentric load.

7. The washing machine according to claim 6, where the extraction tub is a drum rotatable about a horizontal axis.

8. The washing machine according to claim 6, where the extraction tub is a wash-and-extraction tub having a pulsator at its bottom, the wash-and-extraction tub and the pulsator being rotatable about a common tilted axis.

* * * * *